US011247091B2

(12) United States Patent
Sharp

(10) Patent No.: US 11,247,091 B2
(45) Date of Patent: Feb. 15, 2022

(54) FITNESS ACTIVITY APPARATUS

(71) Applicant: Kidstrong, Inc., Prosper, TX (US)

(72) Inventor: Matthew Sharp, Prosper, TX (US)

(73) Assignee: KIDSTRONG, INC., Prosper, TX (US)

( * ) Notice: Subject to any disclaimer, the term of this patent is extended or adjusted under 35 U.S.C. 154(b) by 2 days.

(21) Appl. No.: 16/903,150

(22) Filed: Jun. 16, 2020

(65) Prior Publication Data

US 2021/0086014 A1 Mar. 25, 2021

Related U.S. Application Data

(60) Provisional application No. 62/903,984, filed on Sep. 23, 2019.

(51) Int. Cl.
*A63B 21/012* (2006.01)
*A63B 21/00* (2006.01)

(52) U.S. Cl.
CPC ..... *A63B 21/012* (2013.01); *A63B 21/0004* (2013.01); *A63B 21/151* (2013.01)

(58) Field of Classification Search
CPC ..... A61G 1/007; A63B 21/0442; A63B 21/4035; A63B 21/0728; A63B 21/0552; A63B 21/0004; A63B 21/012; A63B 21/151
See application file for complete search history.

(56) References Cited

U.S. PATENT DOCUMENTS 6,257,599 B1 * 7/2001 Johnson ..... B62B 15/00 280/8
9,643,040 B1 * 5/2017 Guerrero Diaz ..... A63B 21/00069
10,576,322 B2 * 3/2020 Schlegel ..... A63B 69/34
2013/0172160 A1 * 7/2013 Poole ..... A63B 21/0442 482/129
2017/0136285 A1 * 5/2017 Chessen ..... A63B 23/03525

OTHER PUBLICATIONS https://stroops.com/product/predator-sled/?sscid=81k5_b845k#product_details; Date Feb. 4, 2018.*

* cited by examiner

*Primary Examiner* — Nyca T Nguyen
*Assistant Examiner* — Andrew M Kobylarz
(74) *Attorney, Agent, or Firm* — Bennet K. Langlotz; Langlotz Patent & Trademark Works, LLC

(57) ABSTRACT

A fitness activity apparatus has a frame having four vertical posts, the vertical posts comprising a left rear post, a right rear post, a left front post, and a right front post, the left rear post and right rear post being connected by a rear lateral bar, the left front post and right front post being connected by a front lateral bar, the left rear post and left front post being connected by a left side bar, the right rear post and right front post being connected by a right side bar, the left side bar and right side bar being at a common level to provide a support platform configured to support a circular weight plate having a selected plate diameter, and the rear lateral bar positioned at a first vertical level and front lateral bar being positioned at a different second vertical level.

10 Claims, 5 Drawing Sheets

FITNESS ACTIVITY APPARATUS

CROSS-REFERENCE TO RELATED APPLICATION

This application claims the benefit of U.S. Provisional Patent Application No. 62/903,984 filed on Sep. 23, 2019, entitled "FITNESS ACTIVITY APPARATUS," which is hereby incorporated by reference in its entirety for all that is taught and disclosed therein.

FIELD OF THE INVENTION

The present invention relates to physical fitness, and more particularly to a fitness activity apparatus that is used for children's sports activity and training.

BACKGROUND OF THE INVENTION

Regular exercise can help children improve their physical fitness, develop strong bones and muscles, manage weight, improve mental health, and reduce the chances of developing serious health conditions like heart disease, cancer, and type 2 diabetes. For children, conventional weight resistance training to build strong bones and muscles may not be suitable because weight equipment sized for adults can be too heavy or dangerous for children to use.

Therefore, a need exists for a new and improved fitness activity apparatus that enables children to safely engage in weight resistance training. In this regard, the various embodiments of the present invention substantially fulfill at least some of these needs. In this respect, the fitness activity apparatus according to the present invention substantially departs from the conventional concepts and designs of the prior art, and in doing so provides an apparatus primarily developed for the purpose of enabling children to safely engage in weight resistance training.

SUMMARY OF THE INVENTION

The present invention provides an improved fitness activity apparatus, and overcomes the above-mentioned disadvantages and drawbacks of the prior art. As such, the general purpose of the present invention, which will be described subsequently in greater detail, is to provide an improved fitness activity apparatus that has all the advantages of the prior art mentioned above.

To attain this, the preferred embodiment of the present invention essentially comprises a frame having four vertical posts, the vertical posts comprising a left rear post, a right rear post, a left front post, and a right front post, the left rear post and right rear post being connected by a rear lateral bar, the left front post and right front post being connected by a front lateral bar, the left rear post and left front post being connected by a left side bar, the right rear post and right front post being connected by a right side bar, the left side bar and right side bar being at a common level to provide a support platform configured to support a circular weight plate having a selected plate diameter, the left rear post and right front post being spaced apart by a first diagonal spacing greater than the plate diameter by a limited first gap, the right rear post and left front post being spaced apart by a second diagonal spacing greater than the plate diameter by a limited second gap, and the rear lateral bar positioned at a first vertical level and front lateral bar being positioned at a different second vertical level. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
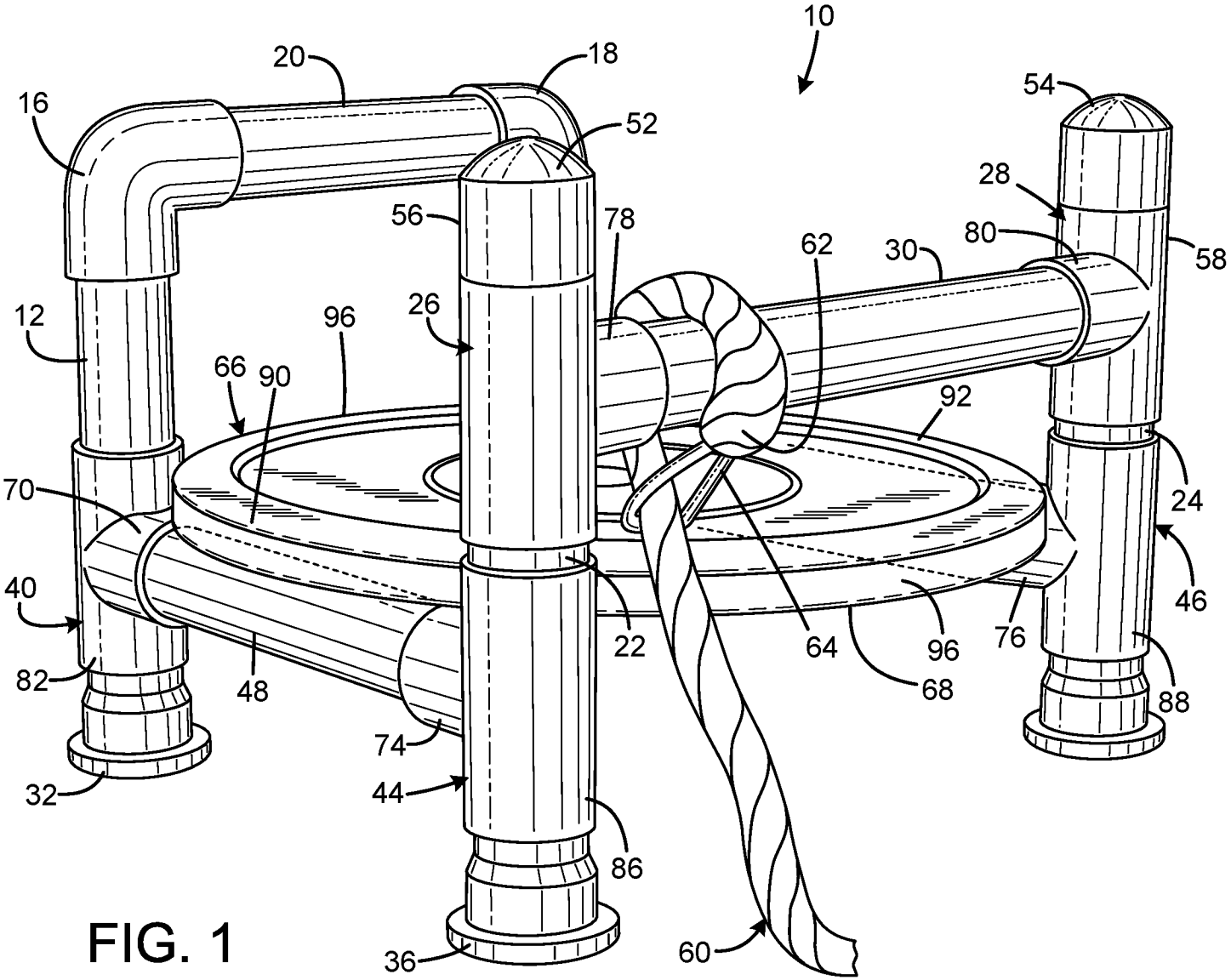
FIG. 1 is a top perspective view of the current embodiment of a fitness activity apparatus constructed in accordance with the principles of the present invention with an optional rope attached.

An embodiment of the fitness activity apparatus of the present invention is shown and generally designated by the reference numeral 10.

Figure 2:
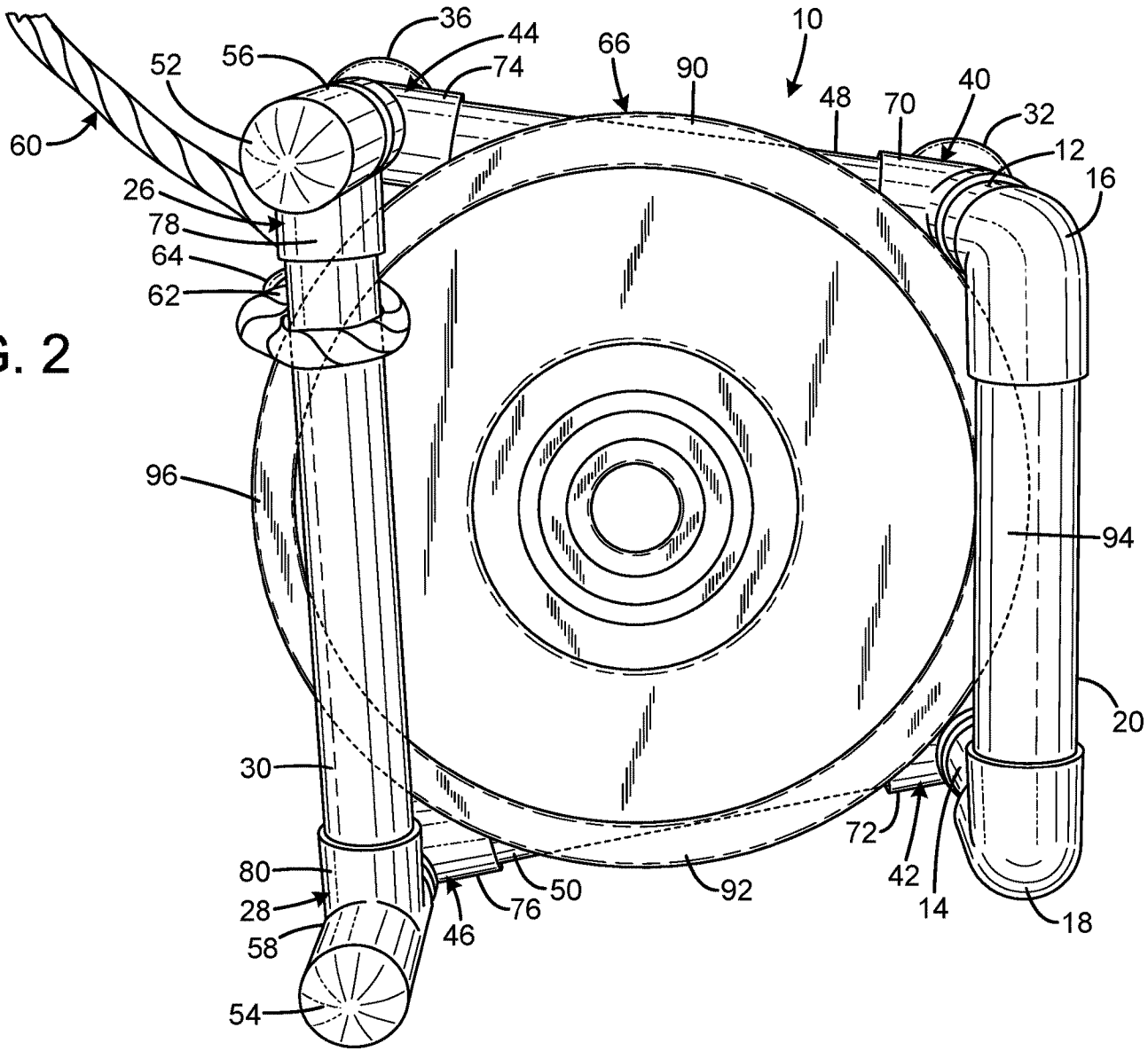
FIG. 2 is a top view of the fitness activity apparatus of FIG. 1 with the optional rope attached.
Figure 3:
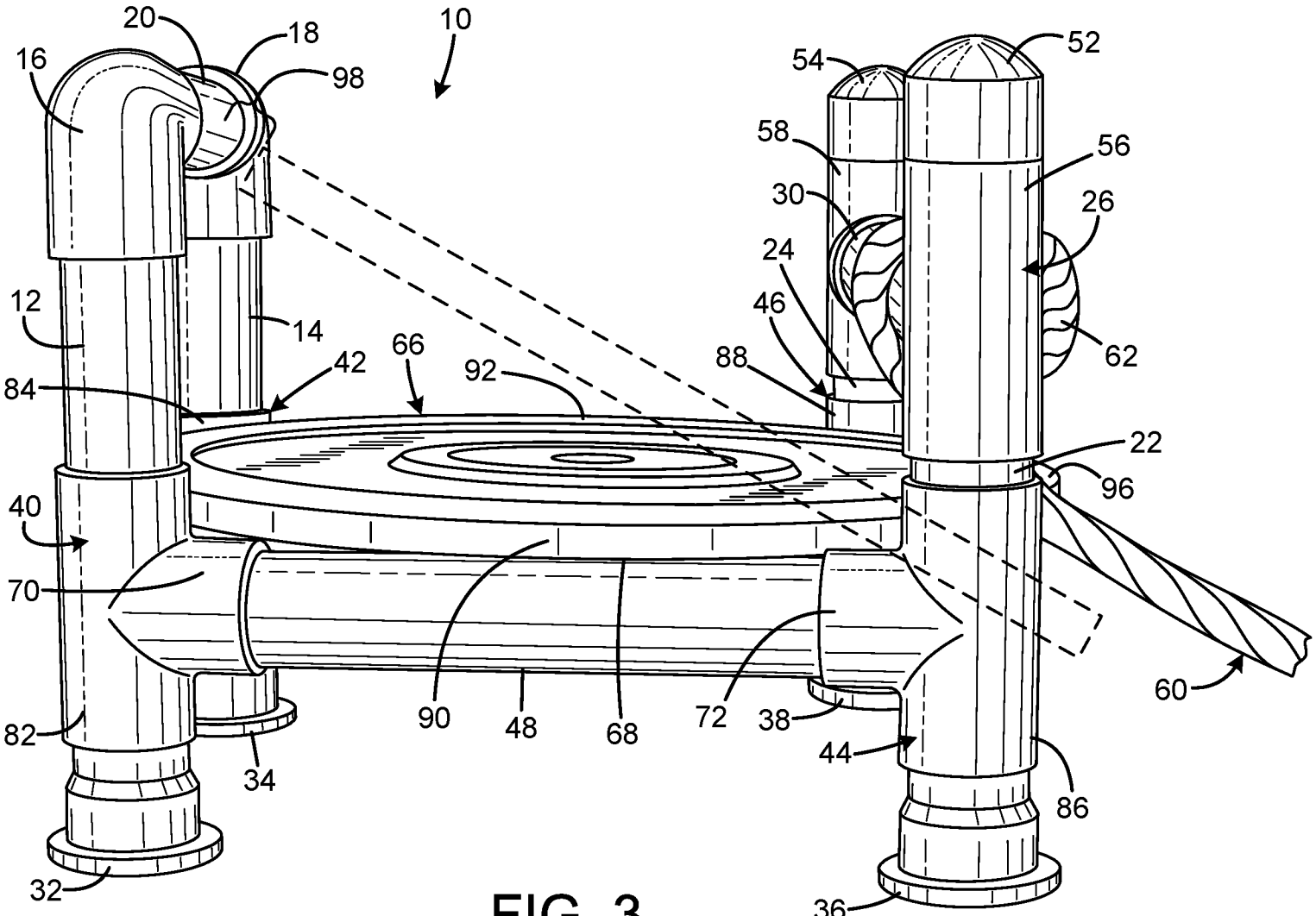
FIG. 3 is a side view of the fitness activity apparatus of FIG. 1 with the optional rope attached.

FIGS. 1-3 illustrate the improved fitness activity apparatus 10 of the present invention. More particularly, the fitness activity apparatus is a sled used for children's sports activity and training. The sled is a four-footed structure with opposed front leg posts 12, 14 connected at their upper end by elbow couplings 16, 18 to a horizontal front handle bar 20. Opposed rear leg posts 22, 24 are connected by T-couplings 26, 28 to a horizontal rear handle bar 30 at an intermediate height lower than the front handle bar. Each of the leg posts has a broad foot 32, 34, 36, 38 at the lower end in the form of a T-shaped element inserted into tubular cylindrical T-couplings 40, 42, 44, 46 connected at the lower end of each of the leg posts. Opposed support bars 48, 50 connect the front and rear leg posts at a level well below the front and rear handle bars. In the current embodiment, the handle bars and leg posts are cylindrical tubes, and the elbow and T-couplings that connect them are conventional plumbing fittings, with end caps 52, 54 covering the upper ends 56, 58 of T-couplings 26, 28. An optional rope 60 has one end 62 removably connected to the rear handle bar by a clip 64. It should be appreciated that for some uses, including use by taller children, the rope may be connected to the front handle bar, so that the user pushes the sled from the opposite direction. A circular weight plate 66 having a bottom 68 rests on the support bars. The weight plate has a diameter slightly less than the diagonal separation between diagonally opposed vertical front and rear leg posts. The weight plate diameter is significantly greater than any of the spaces between adjacent leg posts, so that the plate remains retained securely on the platform provided by the support bars, and cannot slide off between any of the leg posts. The T-couplings that connect the support bars to the leg posts have horizontal portions 70, 72, 74, 76 that receive the ends of the support bars, and extend far enough from the leg posts to provide reinforced contact points for the weight plate, as will be seen below. The T-couplings that connect the rear handle bar to the rear leg posts have horizontal portions 78, 80 that receive the ends of the rear handle bar.

In the current embodiment, the sled has a trapezoidal shape, with the front handle bar 20 being shorter than the support bars 48, 50 and the rear handle bar 30. Portions of the T-couplings' 40, 42, 44, 46 center legs 82, 84, 86, 88 are beneath the weight plate. The weight plate has lobes 90, 92 that extend beyond the limits of the support bars and lobes 94, 96 that extend beyond and beneath the front and rear handle bars. These prevent the weight plate from being lifted vertically off the support bars. Importantly, these also help to retain the weight plate in the sled for safety in the event the sled is accidentally tipped over onto its side or upended.

The dashed lines in FIG. 3 show the weight plate 66 in the process of installation into or removal from the sled. With the weight plate nested firmly at the junctions between the rear leg posts 22, 24 and the support bars 48, 50, the weight plate's rearward position is limited, and these junctions provide a pivot fulcrum for the weight plate's motion. With the weight plate nested in this manner, the weight plate can be pivoted past the front handle bar 20 as shown, with a limited clearance gap 98. The clearance gap is less than the diameters of the front leg posts 12, 14 and the front handle bar, and limited to ensure that the weight plate is securely retained when installed as noted above without impairing ease of installation and removal.

The sled can be viewed as a frame having four vertical posts: a left rear post and right rear post (rear leg posts 22, 24) and a left front post and a right front post (front leg posts 12, 14). The left rear post and right rear post are connected by a rear lateral bar (rear handle bar 30). The left front post and right front post are connected by a front lateral bar (front handle bar 20). The left rear post and left front post are connected by a left side bar (support bar 48). The right rear post and right front post are connected by a right side bar (support bar 50). The left side bar and right side bar are at a common level to provide a support platform configured to support a circular weight plate 66 having a selected plate diameter. The left rear post and right front post are spaced apart by a first diagonal spacing greater than the plate diameter by a limited first gap. The right rear post and left front post are spaced apart by a second diagonal spacing greater than the plate diameter by a limited second gap. The rear lateral bar is positioned at a first vertical level, and the front lateral bar is positioned at a different second vertical level. The left side bar and the left front post define a left interior corner, the right side bar and the right front post define a right interior corner, and the rear lateral bar has a midpoint surface facing toward the left and right interior corners. The left interior corner, right interior corner, and real lateral bar midpoint define a clearance triangle. A circumcircle of the clearance triangle passing through all three corners of the clearance triangle has a diameter greater than the circular weight plate diameter by a limited first clearance amount, such that the circular weight plate may be installed and removed by positioning a forward edge of the circular weight plate against the left and right interior corners and bypassing the rear lateral bar with a rear edge of the circular weight plate. The left side bar and right side bar are positioned at a third vertical level different from the first and second vertical levels. The rear lateral bar is positioned above the left side bar and right side bar. The circular weight plate has a selected plate thickness. A lower surface of the front lateral bar and the support platform are separated by a limited vertical distance greater than the plate thickness by a limited vertical clearance amount. Each of the four vertical posts has a foot 32, 34, 36, 38 at the lower end, and each foot has a width greater than the associated post. In the current embodiment, the four vertical posts and the left and right side bars are cylindrical tubing elements. The cylindrical tubing elements are interconnected with fittings having sleeves (elbow couplings 16, 18 and T-couplings 26, 28, 40, 42, 44, 46) that receive tubing ends.

In the current embodiment, the sled has the following dimensions: the cylindrical tubing elements and fittings all have a size of 2 inch. Each foot has a diameter of 2½ inch. The gap width between the opposed front leg posts 12, 14 is 9 inch. The gap width between the opposed rear leg posts 22, 24 is 14 inch. The overall length of the fitness activity apparatus 10 is 16 inch, the maximum width is 18 inch, the minimum width is 13 inch, the maximum height is 14¼ inch, and the minimum height is 13 inch. The weight plate 66 has a diameter of 17½ inch and is held 6 inch above the floor by the opposed support bars 48, 50.

Figure 4:
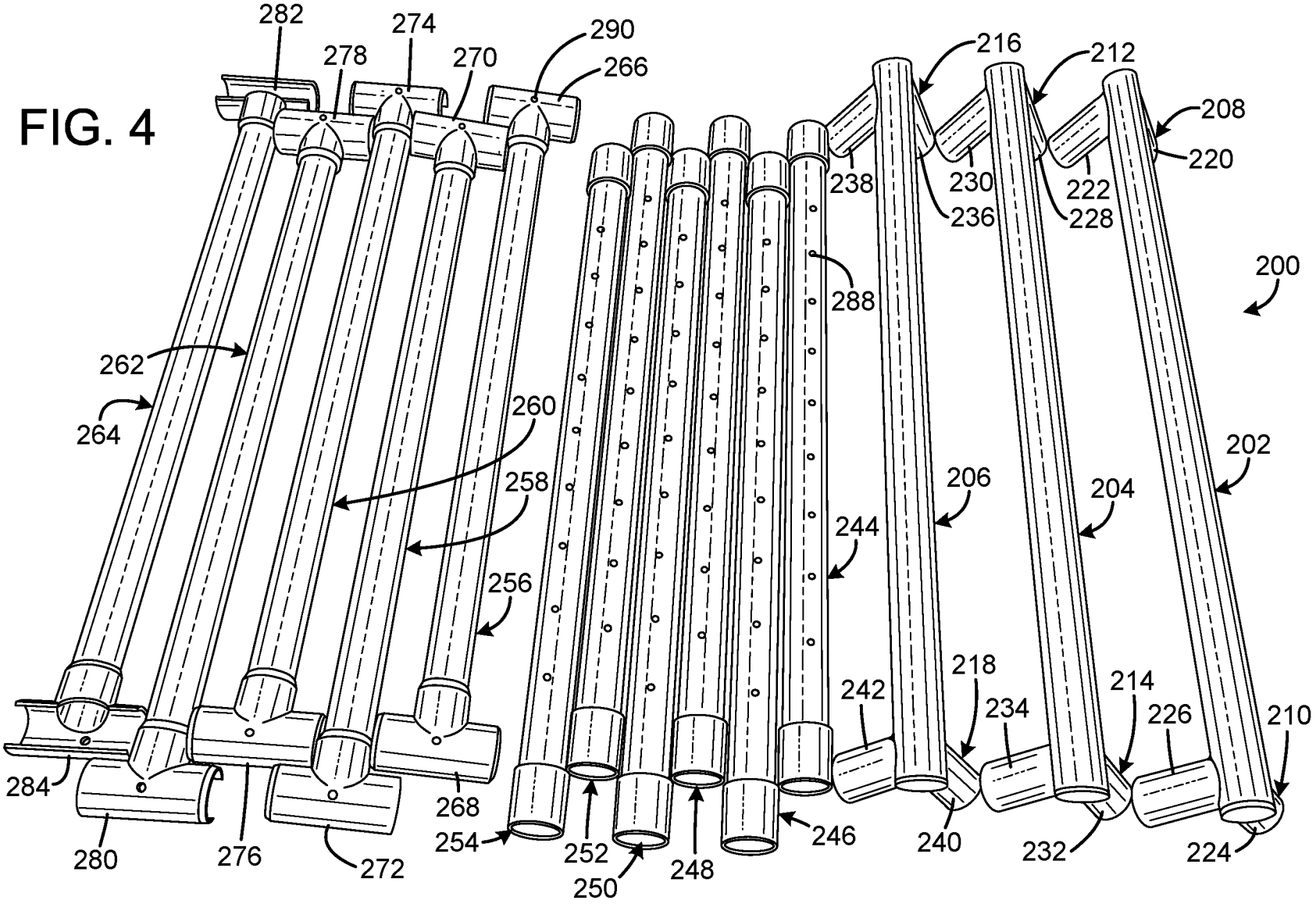
FIG. 4 is a top perspective view of an alternative embodiment of a fitness activity apparatus constructed in accordance with the principles of the present invention in the disassembled condition.
Figure 5:
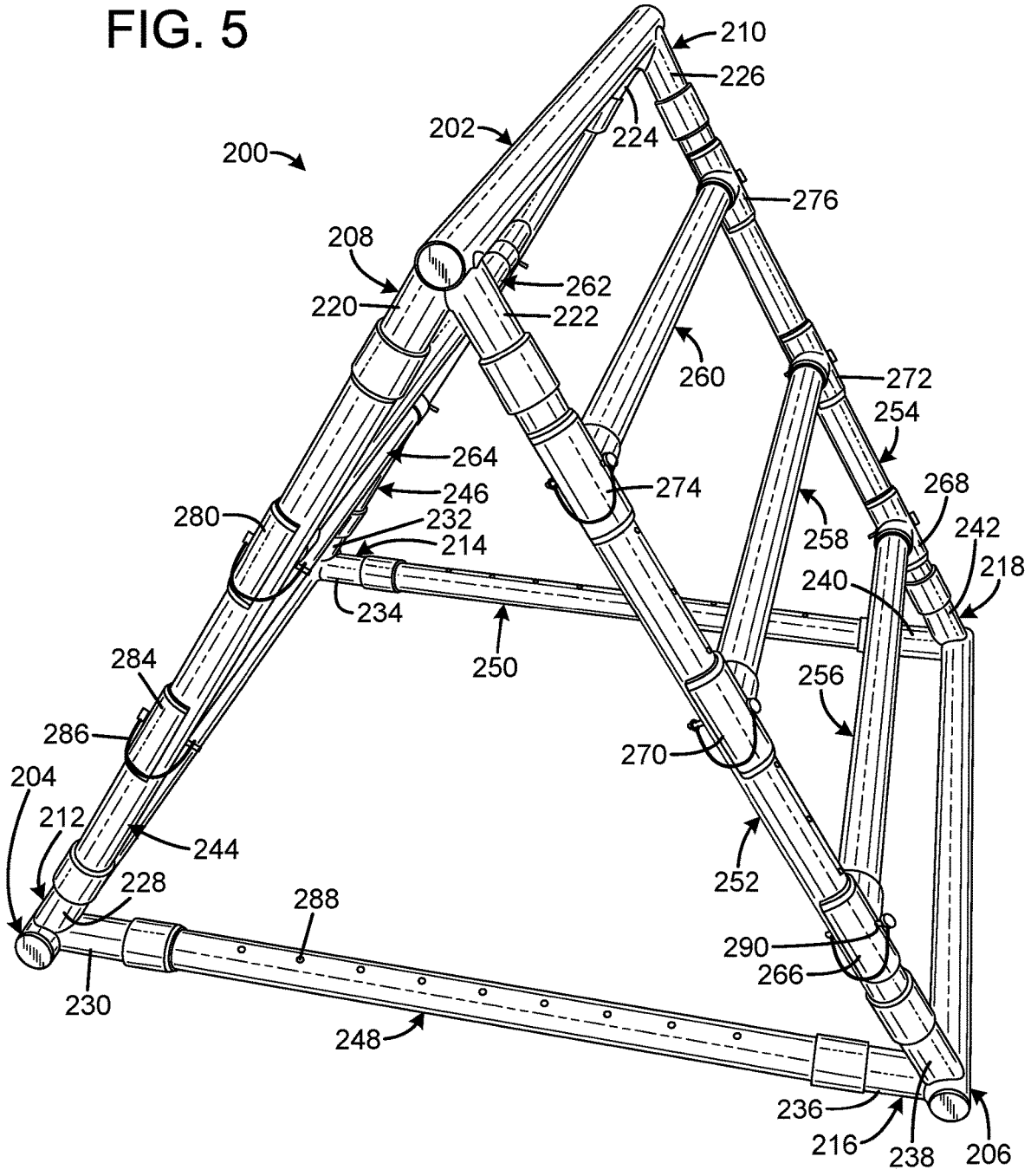
FIG. 5 is a top perspective view of the alternative embodiment of the fitness activity apparatus of FIG. 4 in the assembled condition.

FIGS. 4 & 5 illustrate an alternative embodiment of the improved fitness activity apparatus 200 of the present invention. More particularly, the fitness activity apparatus 200 is a climbing structure shown in a disassembled condition in FIG. 4 and an assembled condition in FIG. 5. The climbing structure is a modular unit that has an equilateral triangular prismatic form with three square or rectangular faces joined at parallel edges and with triangular end faces. The structure is formed by three edge bars 202, 204, 206 each having opposed ends terminated by a fitting 208, 210, 212, 214, 216, 218 having two short cylindrical sleeves 220, 222, 224, 226, 228, 230, 232, 234, 236, 238, 240, 242 perpendicular to the edge bar and at 60° angles with respect to each other. The fittings are preferably welded units, but also can be fabricated by other means. Connecting bars 244, 246, 248, 250, 252, 254 connect securely to the cylindrical sleeves with set screws and form the triangular end faces. The two square or rectangular faces that provide climbing surfaces above the floor can be provided with cross bars 256, 258, 260, 262, 264. The opposed ends of the cross bars are fittings with semi-cylindrical channels 266, 268, 270, 272, 274, 276, 278, 280, 282, 284 perpendicular to the crossbar, which are able to snap over a connecting bar to provide intermediate steps parallel to and between the edge bars. The fittings with semi-cylindrical channels of the cross bars are secured with pins 286 or screws through holes 288 in each of the fittings with channels and an axially registered hole 290 in adjacent connecting bars to avoid slippage. The cross bars may be arranged with different spacings for different activities, user size, and user skill level, with one of the two square or rectangular faces that provide climbing surfaces above the floor shown having two cross bars and one having three cross bars. Optionally, a panel with climbing wall handles or a cargo net (not shown) can each be removably attached to either of the two square or rectangular faces that provide climbing surfaces above the floor.

While current embodiments of a fitness activity apparatus have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sled for fitness activities comprising;

a frame having four vertical posts;

the vertical posts comprising a left rear post, a right rear post, a left front post, and a right front post;

the left rear post and right rear post being connected by a rear lateral bar;

the left front post and right front post being connected by a front lateral bar;

the left rear post and left front post being connected by a left side bar;

the right rear post and right front post being connected by a right side bar;

the left side bar and right side bar being at a common level to provide a support platform;

a circular weight plate having a selected plate diameter configured to be supported on the support platform;

the left rear post and right front post being spaced apart by a first diagonal spacing greater than the plate diameter by a limited first gap;

the right rear post and left front post being spaced apart by a second diagonal spacing greater than the plate diameter by a limited second gap;

the rear lateral bar positioned at a first vertical level and front lateral bar being positioned at a different second vertical level; and wherein the left side bar and the left front post define a left interior corner;

the right side bar and the right front post define a right interior corner;

the rear lateral bar has a midpoint surface facing toward the interior corners;

wherein the left interior corner, right interior corner, and real lateral bar midpoint define a clearance triangle; and a circumcircle of the clearance triangle passing through all three corners of the clearance triangle having a diameter greater than the circular weight plate diameter by a limited first clearance amount, such that the circular weight plate may be installed and removed by positioning a forward edge of the circular weight plate against the left and right interior corners and bypassing the rear lateral bar with a rear edge of the circular weight plate.

2. The sled of claim 1 wherein the posts and bars are cylindrical tubing elements.

3. The sled of claim 2 wherein the cylindrical tubing elements are interconnected with fittings having sleeves that receive tubing ends.

4. The sled of claim 1 wherein the left side bar and right side bar are positioned at a third vertical level different from the first and second vertical levels.

5. The sled of claim 1 wherein the rear lateral bar is positioned above the left side bar and right side bar.

6. The sled of claim 1 wherein the circular weight plate has a selected plate thickness and wherein a lower surface of the front lateral bar and the support platform are separated by a limited vertical distance greater than the plate thickness by a limited vertical clearance amount.

7. The sled of claim 1 wherein each of the four vertical posts has a foot at the lower end, and each foot has a width greater than the associated post.

8. The sled of claim 1 being free of a central post configured to be received in a central aperture of the plate.

9. The sled of claim 1 being free of structures other than the plate within a quadrilateral defined by the posts.

10. The sled of claim 1 being open other than the plate within a quadrilateral defined by the posts.

* * * * *